US008186983B2

(12) United States Patent
Kano

(10) Patent No.: US 8,186,983 B2
(45) Date of Patent: May 29, 2012

(54) GAS COMPRESSOR HAVING A CHECK VALVE

(75) Inventor: Yu Kano, Ageo (JP)

(73) Assignee: Calsonic Kansei Corporation, Saitama-shi (JP)

( * ) Notice: Subject to any disclaimer, the term of this patent is extended or adjusted under 35 U.S.C. 154(b) by 517 days.

(21) Appl. No.: 12/389,712

(22) Filed: Feb. 20, 2009

(65) Prior Publication Data

US 2009/0220370 A1 Sep. 3, 2009

(30) Foreign Application Priority Data

Feb. 28, 2008 (JP) ..... 2008-048471

(51) Int. Cl.

| | |
|---|---|
| ***F01C 21/10*** | (2006.01) |
| ***F03C 2/00*** | (2006.01) |
| ***F03C 4/00*** | (2006.01) |
| ***F04C 2/00*** | (2006.01) |

(52) U.S. Cl. ..... 418/270; 418/133; 418/259; 418/268; 55/400

(58) Field of Classification Search ..... 418/133, 418/259, 266–268, 270; 55/400, 406, DIG. 1, 55/394, 396

See application file for complete search history.

(56) References Cited

U.S. PATENT DOCUMENTS 5,135,370 A * 8/1992 Iio ..... 418/133

FOREIGN PATENT DOCUMENTS

| | | | |
|---|---|---|---|
| JP | 36-15336 | | 9/1961 |
| JP | 63007293 U | * | 1/1988 |
| JP | 06-67970 U | | 9/1994 |
| JP | 2000240580 A | * | 9/2000 |
| JP | 2002257046 A | * | 9/2002 |
| JP | 2006-144636 A | | 6/2006 |

* cited by examiner

*Primary Examiner* — Theresa Trieu
(74) *Attorney, Agent, or Firm* — Foley & Lardner LLP

(57) ABSTRACT

A compressor includes a compression mechanism for suctioning gas through a suction path to compress the gas and discharging the compressed gas and a check valve for preventing backward-flow of the gas in the suction path. The check valve includes an accommodation hole (its one end is opened toward the suction path and its another end is functioned as a reservoir), a valving element accommodated within the accommodation hole movably, a valve seat provided at the opened end of the accommodation hole for closing the suction path while the valving element is pressed thereonto and an urging component for urging the valving element toward the valve seat. A release groove is grooved on an inner surface of the accommodation hole. The reservoir is communicated with the suction path through the release groove. The compressor can reduce machining cost, component count and weight in respect to the check valve.

4 Claims, 3 Drawing Sheets

GAS COMPRESSOR HAVING A CHECK VALVE

BACKGROUND OF THE INVENTION

1. Field of the Invention

The present invention relates to a gas compressor.

2. Description of Related Art

Japanese Patent Application Laid-Open No. 2006-144636 (Patent Document 1) discloses a gas compressor.

As shown in FIG. 5, this gas compressor 201 is a vane type compressor. In the vane type compressor 201, a check valve 205 is provided on a gas suction path 203 through which suctioned refrigerant flows. The check valve 205 prevents gas from flowing backward.

As shown in FIG. 5 or 6, the check valve 205 includes a cylinder 209, a valving element 211, a coil spring 213 and so on. The tubular cylinder 209 is opened toward the gas suction path 203 through a stopper 207 (valve seat). The valving element 211 is accommodated within the cylinder 209 movably. The coil spring 213 urges the valving element 213 toward the stopper 207. The valving element 211 moves within the cylinder 209 according to balance among a restoring force of the coil spring 213, an outside pressure and a pressure in the gas suction path 203. In suction process, the coil spring 213 compressed and the valving element 211 is set back while suctioned refrigerant flows through the gas suction path 203. In compression process, the coil spring 213 makes the valving element 211 contacted with the stopper 207 to close the gas flow path 203 and thereby leakage of refrigerant and oil is prevented.

In addition, the valving element 211 is urged toward the stopper 207 when refrigerant pressure becomes large at a bottom 215 of the cylinder 209. As a result, the above-mentioned balance becomes lost and thereby it may occur that the check valve 201 cannot function normally.

Therefore, refrigerant release paths 217 and 219 are provided in a casing 221 to return the refrigerant stagnating at the bottom 215 to the gas suction path 203. The refrigerant release paths 217 and 219 shown in FIG. 5 are different from those shown in FIG. 6 in their machining order. Since one of the refrigerant release paths 217 and 219 needs to be formed from an outside of the casing 211 in any cases shown in FIGS. 5 and 6, a plug 223 and a gasket 225 is used to prevent leakage of refrigerant and oil.

SUMMARY OF THE INVENTION

Since the two refrigerant release paths 217 and 219 need to be formed independently as described above, the gas compressor in the Patent Document 1 needs many machining processes (working processes).

Since the plug 223 and the gasket 225 are needed further, its component cost must be high. Since a blubber portion (machining margin) 227 is also needed, its weight must be heavy.

Therefore, it is an object of the present invention to provide a gas compressor that can reduce machining cost, component count and weight in respect to a check valve thereof.

An aspect of the present invention is to provide a gas compressor that includes a compression mechanism for suctioning gas through a gas suction path to compress the gas and then discharging the compressed gas and a check valve for preventing the gas from flowing backward in the gas suction path. The check valve includes an accommodation hole (its one end is opened toward the gas suction path and its another end is functioned as a gas reservoir), a valving element accommodated within the accommodation hole movably, a valve seat provided at the opened end of the accommodation hole for closing the gas suction path while the valving element is pressed thereonto and an urging component for urging the valving element toward the valve seat. A gas release groove is grooved on an inner surface of the accommodation hole. The gas reservoir is communicated with the gas suction path through the gas release groove.

According to the aspect of the present invention, gas within the gas reservoir can be returned to the gas suction path through the gas release groove. Therefore, it is prevented that backpressure of the valving element becomes excessively high due to gas stagnation within the gas reservoir. As a result, the check valve can operate unfailingly.

In addition, machining cost and component cost can be reduced more drastically than those of a conventional one (it needs the two refrigerant release paths 217 and 219, the plug 223 and the gasket 225, as mentioned above) because the release groove is provided on the inner surface of the accommodation hole.

Further, the compressor can be light-weighted because machining margin (such the blubber portion 227 for the refrigerant release paths 217 and 219 as mentioned above is not needed).

It is preferable that the gas suction path is made tapered and a cross-sectional area thereof is made larger toward downstream of gas flow, and the gas release groove is provided at a downstream side of the gas flow on the inner surface of the accommodation hole.

According to this configuration, a length of the gas release groove can be shortened most because the gas release groove is provided at a downstream side of the gas flow on the inner surface of the tapered accommodation hole. Therefore, gas flowing resistance can be reduced and thereby the gas can flow efficiently between the gas reservoir and the gas suction path through the gas release groove.

It is preferable that the gas release groove is grooved linearly along the accommodation hole.

According to this configuration, the flowing resistance can be reduced further because the gas release groove is formed linearly. Therefore, gas can flow more efficiently between the gas reservoir and the gas suction path through the gas release groove. In addition, machining cost can be reduced further because it is easy to form the gas release groove linearly on the inner surface of the accommodation hole.

It is preferable that the compression mechanism includes a rotor capable of rotating inside the a cam surface, a plurality of vane slots formed on the rotor, a plurality of vanes capable of reciprocating within the plurality of vane slots, respectively, and a plurality of compression chambers formed between the cam surface and the rotor and segmented by the plurality of vanes. Each capacity of the plurality of compression chambers changes along with rotation of the rotor. The gas is suctioned through the gas suction path, compressed and then discharged through due to capacity change of the plurality of compression chambers while the rotor rotates.

According to this configuration, the compressor is a vane type compressor that can be made small and light-weighted. In addition, a vane type compressor can be manufactured with ease relatively. A vane type compressor is suitable for a relatively small discharge capacity.

DETAILED DESCRIPTION OF THE EMBODIMENT

A vane type compressor (gas compressor) 1 according to an embodiment of the present invention will be explained with reference to FIGS. 1 to 4.

Figure 1:
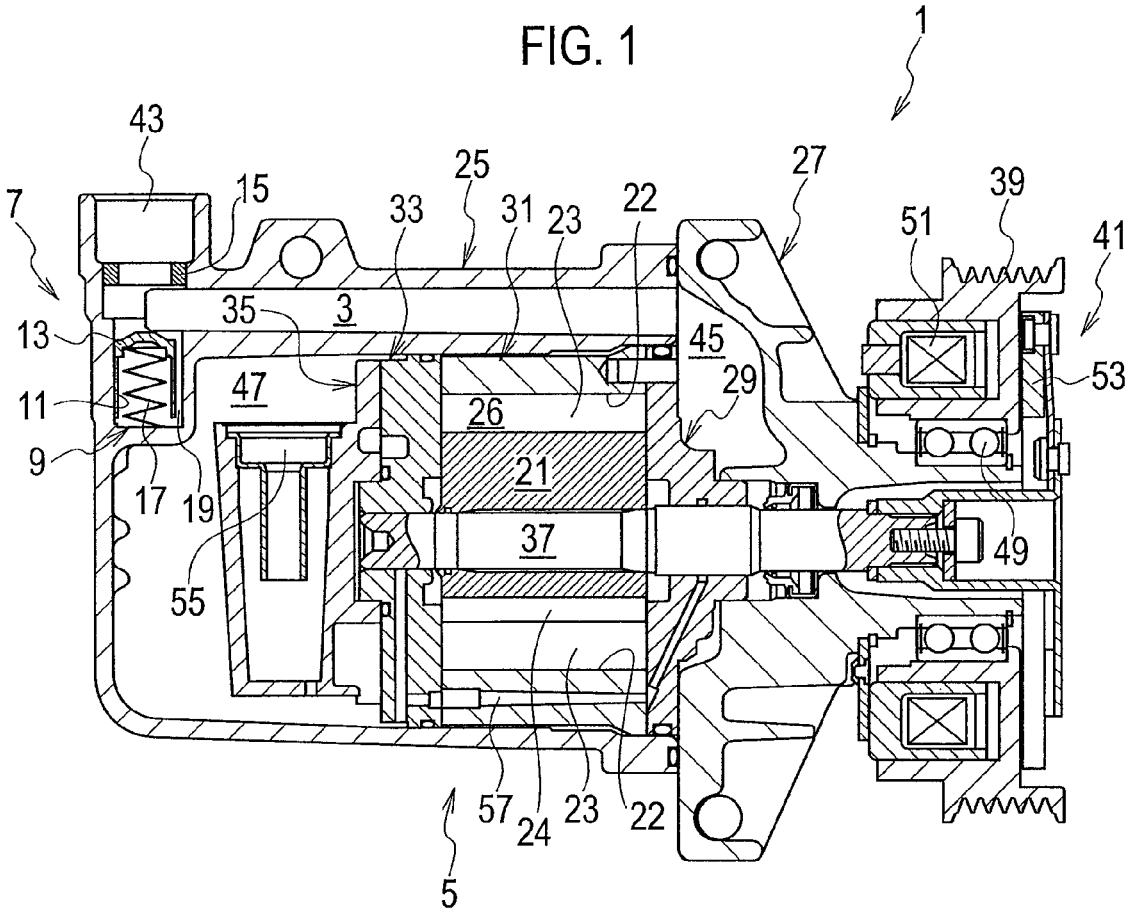
FIG. 1 is a cross sectional view of a vane type compressor 1 according to an embodiment of the present invention.

As shown in FIG. 1, the vane type compressor 1 includes a compression mechanism 5 and a check valve 7. The compression mechanism 5 suctions refrigerant (gas) through a gas suction path 3 and then compress the refrigerant to discharge it through a gas discharge path. The check valve 7 prevents the refrigerant from flowing backward in the gas suction path 3.

The check valve 7 includes a sleeve (accommodation hole) 11, a core (valving element) 13, a stopper (valve seat) 15 and a coil spring (urging component) 17. One end of the sleeve 11 is opened toward the gas suction path 3 and another end functions as a gas reservoir 9. The core 13 is accommodated within the sleeve 11 movably. The stopper 15 is provided at the opened end of the sleeve 11. The gas suction path 3 is closed when the core 13 is pressed onto the stopper 15. The coil spring 17 urges the core 13 toward the stopper 15.

A gas release groove 19 is grooved on an inner surface of the sleeve 11. The gas reservoir 9 is communicated with the gas suction path 3 via the gas release groove 19.

The gas suction path 3 is made tapered and its cross-sectional area is made larger toward downstream of the suctioned refrigerant flow. The gas release groove 19 is provided at a downstream side of the refrigerant flow on the inner surface of the sleeve 11

The gas release groove 19 is provided linearly along the sleeve 11.

The compression mechanism 5 includes a rotor 21, vane slots 24, vanes 23 and plural compression chambers 26. The rotor 21 rotates inside a cam surface 22. The vane slots 24 are formed on the rotor 21. The vanes 23 reciprocate within the vane slots 24, respectively, with contacting with the cam surface 22 along with a rotation of the rotor. The compression chambers 26 are formed between the cam surface 22 and the rotor 21 and segmented by the vanes 23. Each capacity of the compression chambers 26 changes along with the rotation of the rotor 21. The refrigerant is suctioned through the gas suction path 3, compressed and then discharged through a gas discharge path due to the above-mentioned capacity change while the rotor 21 rotates.

Next, configuration of the vane type compressor 1 will be explained.

The vane type compressor 1 is applied to a refrigerant system in an air conditioning unit for a vehicle. High temperature and high pressure refrigerant adiabatically compressed by the compressor 1 is liquefied by a condenser and then adiabatically expanded by an expansion valve. Subsequently, the refrigerant is evaporated with being heated by an evaporator to generate cooled air and then returned to the compressor 1 to be adiabatically compressed again. Note that a proper amount of lubricating oil is included in the refrigerant gas.

As shown in FIG. 1, the vane type compressor 1 includes a casing 25, a front casing 27, a front block 29, a cylinder block 31, a rear block 33, a cyclone block 35, a rotor axis 37, an input pulley 39, an electromagnetic clutch 41 and so on. The casing 25 and the front casing 27 are fixed integrally by bolts. Each of the blocks 29, 31 and 33 is fixed integrally on the front casing 27 by bolts. The cyclone block 35 is fixed on the rear block 33 by bolts.

A center of the rotor axis 37 is supported rotatably by the front block 29. A left end of the rotor axis 37 is supported rotatably by the rear block 33. The rotor 21 is spline-coupled with the rotor axis 37. The cam surface 22 has an almost ellipsoidal profile and provided within the cylinder block 31. The vane slots 24 are provided on the rotor 21 at even intervals and extend radially to support the vanes 23 reciprocatably.

A suction port 43 is provided in the casing 25. The suction port 43 is connected to the evaporator in the refrigerant cycle. A suction chamber 45 is provided between the casing 25 and the front casing 27. The suction port 43 is communicated with the suction chamber 45 through the gas suction path 3. In addition, a discharge chamber 47 is provided between the casing 25 and the rear block 33. The discharge chamber is connected to the condenser in the refrigerant cycle via a discharge port.

The input pulley 39 is supported on the front casing 27 via a bearing 49. The electromagnetic clutch 41 is engaged to connect the input pulley 39 and the rotor axis 37 while an armature 53 is attracted by an electromagnetic solenoid 51. The vane type compressor 1 is driven by an engine while the electromagnetic clutch 41 is engaged. The vane type compressor 1 is disconnected with the engine when the electromagnetic clutch 41 is disengaged.

The compression chambers 26 are formed between the cam surface 22 and an outer circumferential surface of the rotor 21 and segmented by the vanes 23. While the vane type compressor 1 is driven and the rotor 21 is rotated, each of the vanes 23 projects outward due to a centrifugal force applied thereto and an after-mentioned back pressure (oil pressure) supplied to the vane slots 24 to make its top edge contacted with the cam surface 22. Each capacity of the compression chamber is varied according to the rotation of the rotor 21 and the reciprocation of the vanes 23 in the vane slots 24 owing to the rotation. As a result, a suction process, a compression process and a discharge process are done repeatedly. In the suction process, refrigerant is suctioned through the suction port 43, the gas suction path 3 and the suction chamber 45. In the compression process, the suctioned refrigerant is compressed within the compression chambers 26. In the discharge process, the compressed refrigerant is discharged through the discharge chamber 47 and the discharge port. In the cyclone block 35, oil is separated by an oil separator 55 from the refrigerant temporally staying in the discharge chamber 47. The separated oil is accumulated on a bottom of the discharge chamber 47 and then supplied to bearings of the rotor axis 37 in the blocks 29 and 33 through oil paths 57 to lubricate the bearings. In addition, the separated oil is also supplied to the vane slots 24 to apply the backpressure to the vanes 23.

Figure 2:
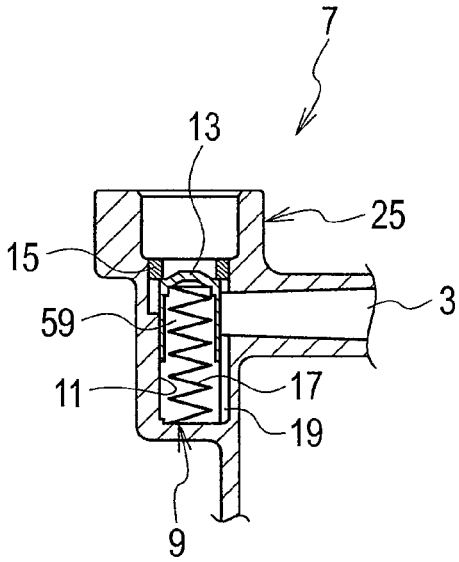
FIG. 2 is an enlarged cross sectional view showing a main portion in the vane type compressor 1.

As shown in FIG. 2, a cavity 59 is provided inside the core 13 of the check valve 7. The cavity 59 is communicated with the gas reservoir 9. In the processes other than the suction process, the coil spring 17 presses the core 13 onto the stopper 15 to close the gas suction path 3. As a result, leakage of refrigerant and oil to outside can be prevented. In this time, a pressing force for pressing the core 13 onto the stopper 15 by the coil spring 17 (a function to close the gas suction path 3) is strengthen with a pressure by the refrigerant flowing into the gas reservoir 9 and the cavity 59 through the gas release groove 19. In the suction process, the coil spring 17 is compressed due to the balance between the inside pressure and the outside pressure. Therefore, the core 13 is set back from the stopper 15 to open the gas suction path 13. As a result, refrigerant is suctioned into the suction chamber 45.

Capacity of the gas reservoir 9 changes due to moving of the core 13 as described above. This capacity change generates the refrigerant flow between the gas reservoir 9 and the gas suction path 3 through the gas release groove 19. Since it is prevented that the refrigerant (pressure) stays within the gas reservoir 9, flowing resistance due to the pressure can be prevented. Therefore, the core 13 can move smoothly and lightly.

Figure 3:
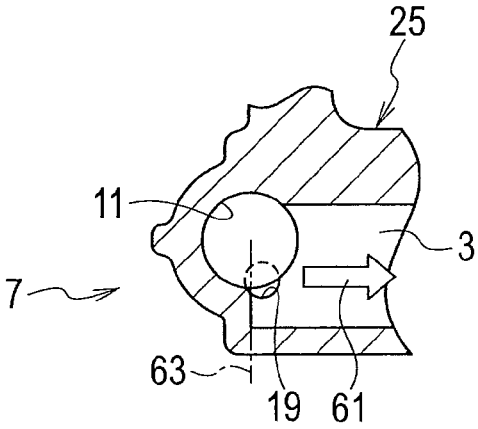
FIG. 3 is another enlarged cross sectional view showing the main portion in the vane type compressor 1.
Figure 4:
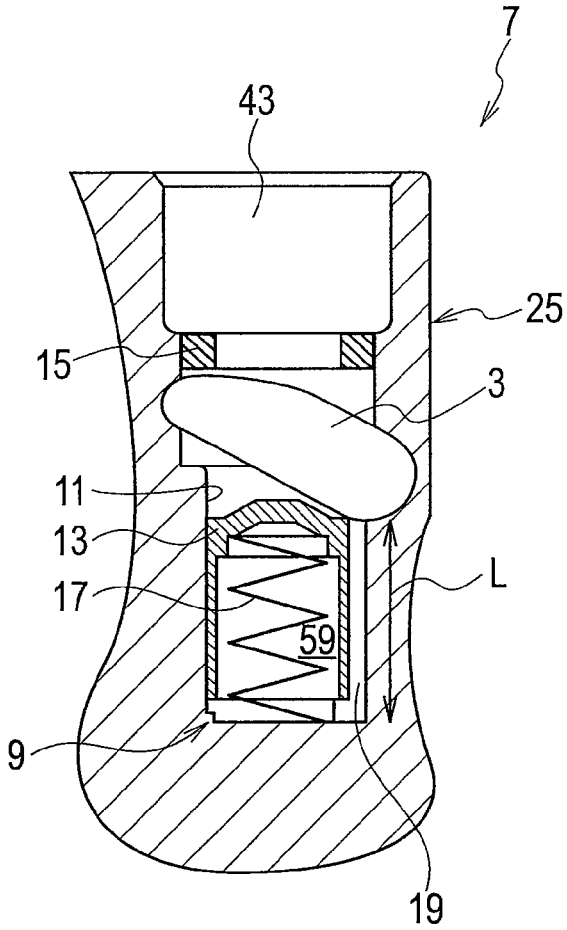
FIG. 4 is yet another enlarged cross sectional view showing the main portion in the vane type compressor 1.
Figure 5:
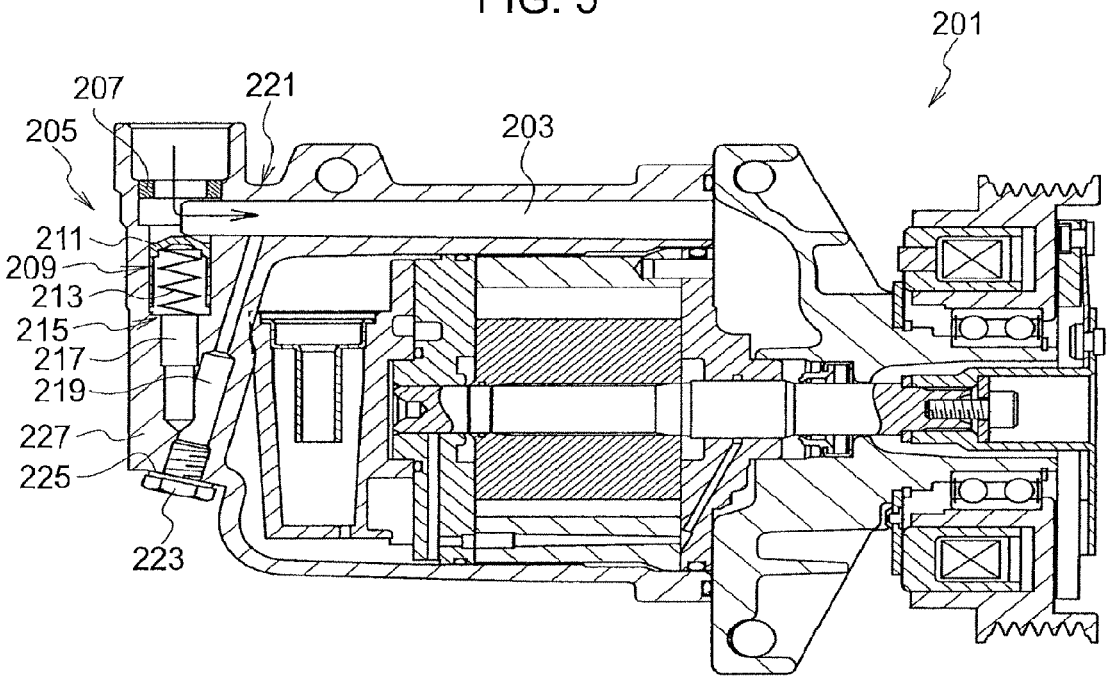
FIG. 5 is a cross sectional view of a conventional vane type compressor.
Figure 6:
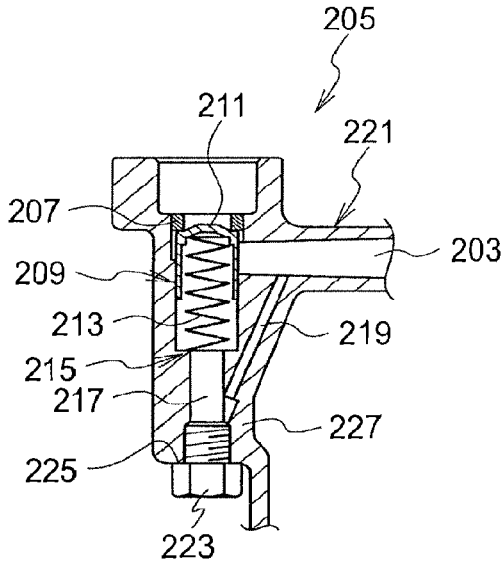
PRIOR ART FIG. 6
FIG. 6 is an enlarged cross sectional view showing a main portion in a modified example of the conventional vane type compressor.

An arrow shown in FIG. 3 indicates a flowing direction of the refrigerant within the gas suction path 3 in the suction process. Since the gas release groove 19 is provided at the downstream side of the refrigerant flow in respect to a reference line 63 passing through the center of the sleeve 11, the refrigerant flowing through the gas release groove 19 is involved with the refrigerant flowing within the gas suction path 3 and then urged to flow fast and smooth. As a result, the refrigerant in the gas reservoir 9 can be returned to the gas suction path 3 efficiently.

In addition, the gas suction path 3 is made tapered and its cross-sectional area is made larger toward the suction chamber 45 as shown in FIG. 1 (along a flowing direction of the refrigerant indicated by an arrow 61 shown in FIG. 3). Furthermore, the gas release groove 19 is opened at the downstream side of the refrigerant flow as shown in FIG. 3 (at a position that can involve a larger inner diameter of the tapered gas suction path 3) and formed linearly. Therefore, a length L of the gas release groove 19 (see FIG. 4) can be most shortened. As a result, the flowing resistance can be made extremely small to flow the refrigerant efficiently.

Next, advantages of the vane type compressor 1 will be explained.

Since the gas release groove 19 is provided on the inner surface of the sleeve 11, machining cost and component cost can be reduced more drastically than those of a conventional one that needs the two refrigerant release paths 217 and 219, the plug 223 and the gasket 225.

Since the machining margin (blubber portion 227) for the refrigerant release paths 217 and 219 in the conventional one is not needed, the compressor 1 according to the present embodiment can be made light-weighted.

Since the gas release groove 19 is opened at a large inner diameter side of the tapered gas suction path 3 to most-shorten the length L, flowing resistance of the refrigerant can be reduced. Therefore, the refrigerant can flow efficiently between the gas reservoir 9 and the gas suction path 3 through the gas release groove 19.

Since the gas release groove 19 is formed linearly to reduce the flowing resistance further, the refrigerant can flow more efficiently.

Since the linear gas release groove 19 can be formed at ease, its machining cost can be reduced further.

Note that the present invention is not limited to the above-explained embodiments and can take various modification within a technical scope of the present invention.

For example, the gas compressor according to the present invention may be another type compressor other than a vane type compressor. In addition, the gas compressor according to the present invention may be applied to another system or the like other than a refrigerant system using refrigerant. Furthermore, the gas to be compressed by the gas compressor according to the present invention may be a gas other than refrigerant.

This application claims priority from Japanese Patent Application 2008-048471, filed Feb. 28, 2008, which is incorporated herein by reference in its entirety.

What is claimed is:

1. A gas compressor comprising:

a compression mechanism for suctioning gas through a gas suction path to compress the gas and then discharging the compressed gas; and a check valve for preventing the gas from flowing backward in the gas suction path, wherein:

the check valve includes:

an accommodation hole, one end of the accommodation hole opened toward the gas suction path and another end of the accommodation hole being functioned as a gas reservoir;

a valving element accommodated within the accommodation hole movably;

a valve seat provided at the opened end of the accommodation hole for closing the gas suction path while the valving element is pressed onto the valve seat; and an urging component for urging the valving element toward the valve seat, a gas release groove grooved on an inner surface of the accommodation hole, the gas reservoir is communicated with the gas suction path through the gas release groove, and the gas release groove is grooved linearly along the accommodation hole.

2. The gas compressor according to claim 1, wherein:

the gas suction path is made tapered and a cross-sectional area of the gas suction path is made larger toward downstream of gas flow, and the gas release groove is at a downstream side of the gas flow on the inner surface of the accommodation hole.

3. The gas compressor according to claim 2, wherein:

the compression mechanism includes:

a rotor that rotates inside a cam surface;

a plurality of vane slots formed on the rotor;

a plurality of vanes that reciprocate within the plurality of vane slots, respectively; and a plurality of compression chambers formed between the cam surface and the rotor and segmented by the plurality of vanes, each capacity of the plurality of compression chambers changes along with rotation of the rotor, and the gas is suctioned through the gas suction path, compressed and then discharged through due to capacity change of the plurality of compression chambers while the rotor rotates.

4. The gas compressor according to claim 1, wherein:

the compression mechanism includes:

a rotor that rotates inside a cam surface;

a plurality of vane slots formed on the rotor;

a plurality of vanes that reciprocate within the plurality of vane slots, respectively; and a plurality of compression chambers formed between the cam surface and the rotor and segmented by the plurality of vanes, each capacity of the plurality of compression chambers changes along with rotation of the rotor, and the gas is suctioned through the gas suction path, compressed and then discharged through due to capacity change of the plurality of compression chambers while the rotor rotates.

* * * * *